US005269885A

United States Patent [19]

Tavi

[11] Patent Number: 5,269,885

[45] Date of Patent: Dec. 14, 1993

[54] PRESS SECTION OF A PAPER OR PAPERBOARD MAKING MACHINE

[75] Inventor: Seppo Tavi, Jyväskylä, Finland

[73] Assignee: Valmet Paper Machinery, Finland

[21] Appl. No.: 781,983

[22] Filed: Oct. 24, 1991

Related U.S. Application Data

[63] Continuation of Ser. No. 524,300, May 15, 1990, abandoned.

[30] Foreign Application Priority Data

May 30, 1989 [FI] Finland ..... 892625

[51] Int. Cl.[5] ..... D21F 3/08

[52] U.S. Cl. ..... 162/358.1; 162/361

[58] Field of Search ..... 162/358.1, 361, 360.1, 162/205, 206; 100/162 B, 162 R; 29/116.2; 492/7

[56] References Cited

U.S. PATENT DOCUMENTS

| | | | |
|---|---|---|---|
| 4,086,131 | 4/1978 | Rempel et al. | 162/205 |
| 4,209,361 | 6/1980 | Kankaanpaa | 162/205 |
| 4,224,104 | 9/1980 | Kankaanpaa | 162/205 |
| 4,520,723 | 6/1985 | Par | 100/162 |
| 4,975,153 | 12/1990 | Nelson | 162/358 |
| 4,988,410 | 1/1991 | Meinecke et al. | 162/360.1 |

*Primary Examiner*—W. Gary Jones
*Assistant Examiner*—Brenda Lamb
*Attorney, Agent, or Firm*—Steinberg & Raskin

[57] ABSTRACT

The invention concerns a press section of a paper or paperboard making machine, comprising a number of rolls (1, 11, 22, 32, 44, 70) which forms press nips ($N_1$, $N_2$, $N_3$, $N_4$) that dewater the web (W) with each other, the web being arranged to run through these nips. Of the rolls at least one roll (1;70) is a smooth-faced so-called center roll, which forms a press nip ($N_2$, $N_3$;$N_4$) with at least one other press roll (11, 32, 44), over which a press felt (10, 30; 40), which has been formed as an endless loop, is passed to absorb water from the web (W). The center roll (1; 70) in accordance with the invention is a variable-crown roll, which comprises a metallic roll mantle (2; 71) arranged to revolve around a stationary roll axle (3; 72). The roll includes at least one set of crown-variation members (4, 5; 73), which are arranged to load the roll mantle (2; 71) in the direction of the nip plane ($K_2$, $K_3$; $K_4$) of the center roll (1; 70) and the roll (11, 32; 44) that forms a press nip $N_2$, $N_3$; $N_4$) with the center roll so as to regulate the linear load profile in the nip ($N_2$, $N_3$; $N_4$).

12 Claims, 4 Drawing Sheets

PRESS SECTION OF A PAPER OR PAPERBOARD MAKING MACHINE

This is a continuation of application Ser. No. 07/524,300, filed May 15, 1990, now abandoned.

BACKGROUND OF THE INVENTION

The invention concerns a press section of a paper or paperboard making machine, comprising a number of rolls which form press nips that dewater the web, the web being arranged to run through these nips, and of which rolls at least one roll is a smooth-faced so-called center roll, which forms a press nip with at least one other press roll, over which a press felt, which has been formed as an endless loop, is passed to absorb water from the web.

In a paper making machine, out of fiber pulp, a web is formed in the former of the paper machine, whereupon the formed web is passed, being supported and carried by one or more felts in the paper making machine, into the press section of the paper making machine, wherein both the web and the felts that support it are passed through nips formed by the rolls in the press section to absorb water from the web into the felts. From the press section the web is passed into the drying section of the paper machine. A conventional construction in a press section comprises a large and massive center roll as well as wire or felt loops grouped around it, the rolls placed inside these felt loops forming press nips either with one another or together with the center roll, and when the web runs through said press nips, water is drained out of the web by the effect of compression, this water being absorbed into the felts. In the drying section, water is removed from the web by means of evaporation, which is highly energy-consuming and therefore expensive and uneconomical. This is why attempts are made to remove a maximal proportion of water out of the web before it reaches the drying section, in the press section, by mechanical means.

It is known from the prior art that water is removed out of a web considerably more readily at an elevated temperature, because the viscosity of water and the springback coefficient of the web are thereby lowered together with the surface tension. Owing to this plienomenon, it has been previously found desirable to raise the temperature of the web in the press section. Based on this earlier experience, it can be established that, e.g., an increase in the temperature by 6° . . . 10° C. in the press section produces an increase of an order of 1% or more in the dry solids content of the web. An increased dry solids content in the press section produces considerable cost economies. For example, in paper making machines a rule of thumb is that, if the moisture content in the web in the press section can be lowered by 1%, the consumption of steam in the drying section is lowered by about 5%.

One drawback in the press sections which have been heretofore commonly used relates to the center roll in the press section. Generally, some suitable rock, such as granite, is used for the center roll. As is well known, rock rolls are quite sensitive to large and sudden changes in temperature, and the effects of such changes may be so severe as to crack the roll. This is why attempts have been made to develop suitable substitutes for granite rolls. As substitutes for rock rolls, e.g., rolls have been used which are coated, e.g., with a mixture of polyurethane and rock dust to make the surface properties of the roll similar to those of a rock roll. Advantages of metal rolls compared with rock rolls include their considerably better ability to tolerate variations in temperature. Moreover, owing to this phenomenon, they can be run at considerably higher temperatures than rock rolls. Moreover, a metal roll can be run at considerably higher running speeds than rock rolls.

A conventional construction of the press section of a paper machine wherein a center roll and a plurality of press rolls grouped around it are employed constitutes three press nips. In such a construction, the first press nip is formed between a grooved roll and a press-suction roll. In this construction, the second press nip is formed between a press-suction roll and the center roll, and a third press nip is formed between the center roll and a second grooved roll. Since, in the nips in the press section, it must be possible to make the linear loads as uniform as possible, in such a structure, as a rule, the grooved rolls are variable-crown rolls, preferably rolls whose crowns are variable in zones thereof. Thus, owing to the crown variation of the grooved rolls, in the first nip and in the third nip in the press section, a uniform linear load is achieved. In order that a linear load as uniform as possible can also be obtained for the second press nip, the mantles of the press-section roll and the center roll, which form the second press nip, are generally cambered. Because of the camber, a uniform linear load is never obtained for a nip and it is a further drawback of the cambering that the camber is always "fixed". If the camber has to be changed, the roll must be subjected to a grinding operation. This is a costly and laborious procedure. Also, cambering alone does not render the linear load profile subject to full control. For example, a problem with the metallic center rolls presently in use has been uneven heating. This has caused distortions in the linear load profile. Since the grooved rolls are provided with crown-variation means, the grooved rolls have been highly expensive. In this respect, the high cost has also been contributed to by the fact that it has been difficult to fit the crown-variation means inside a grooved roll, because the diameters of the grooved rolls are relatively small. When a fourth, separate press nip has been added to such a press section, a variable-crown grooved roll has also been used to achieve the fourth press nip.

Thus, to summarize the drawbacks of the prior art, they include high cost of construction, the aforementioned problems of uneven temperature related to metallic rolls, as well as the difficulties in providing uniform and, if necessary, adjustable profiles of linear loads in the press nips.

SUMMARY OF THE INVENTION

The principal object of the present invention is to provide a press section by means of which the drawbacks described above are minimized and by means of which an essential improvement is obtained with respect to increased dry solids content and increased running speed of a web passing through a paper making machine. A further object is to provide a structure to substitute for the rock rolls employed in press sections. With a view to achieving these objectives, the solution in accordance with the invention is mainly characterized in that the center roll is a variable-crown roll, which comprises a metallic roll mantle arranged so as to revolve around a stationary roll axle as well as at least one set of crown-variation means, which are arranged to load the roll mantle in the direction of the nip plane of the center roll and the roll that forms a press nip with the center roll so as to regulate the linear load profile in the nip.

As compared with the prior art, by means of the invention, a number of advantages are obtained, some of which have been heretofore discussed. With regard to the invention's advantages, the following can also be mentioned. First, in accordance with the invention, if necessary or desirable, two variable-crown rolls can be replaced by one variable-crown roll. Use of this option results in considerable economical savings. Since the crown-variation means are used exclusively in connection with the center roll, it is considerably easier to construct these members in the interior of the roll, because the available space is larger. With the use of the present invention, if desirable, it is also possible to control the profile of linear loads in the nip between a press-section roll and the center roll.

Moreover, by means of the structure in accordance with the invention, problems related to the uneven heating of the prior-art metallic center rolls are avoided. When the structure of the invention is used, the mantle of the center roll can be made thinner than in the prior art, whereby it has an improved thermal conductivity. If desired, the roll can also be used for heating the web. Nor is it necessary to grind any camber on a roll to achieve the press section structure in accordance with the invention.

An additional advantage obtainable by means of the invention is related to the construction of the grooved rolls that are presently used. Currently, the grooved rolls are manufactured such that they are provided with a suitable coating, e.g., of polyurethane. This results in their having a limited ability to tolerate heat. Variable-crown rolls, and in particular rolls whose crowns are adjustable in zones thereof, however, develop a considerable amount of heat. Since, when a structure in accordance with the invention is used, the grooved rolls therein do not have to be variable-crown rolls, they can be provided with cooling in a simple manner. An additional advantage is that the invention can be utilized as an addition to existing press sections. Other advantages of the invention are explained hereinafter in the detailed description of the invention.

BRIEF DESCRIPTION OF THE DRAWING

In the following, the invention will be described in detail with reference to the Figures in the accompanying drawings.

DESCRIPTION OF THE PREFERRED EMBODIMENTS

Figure 1:
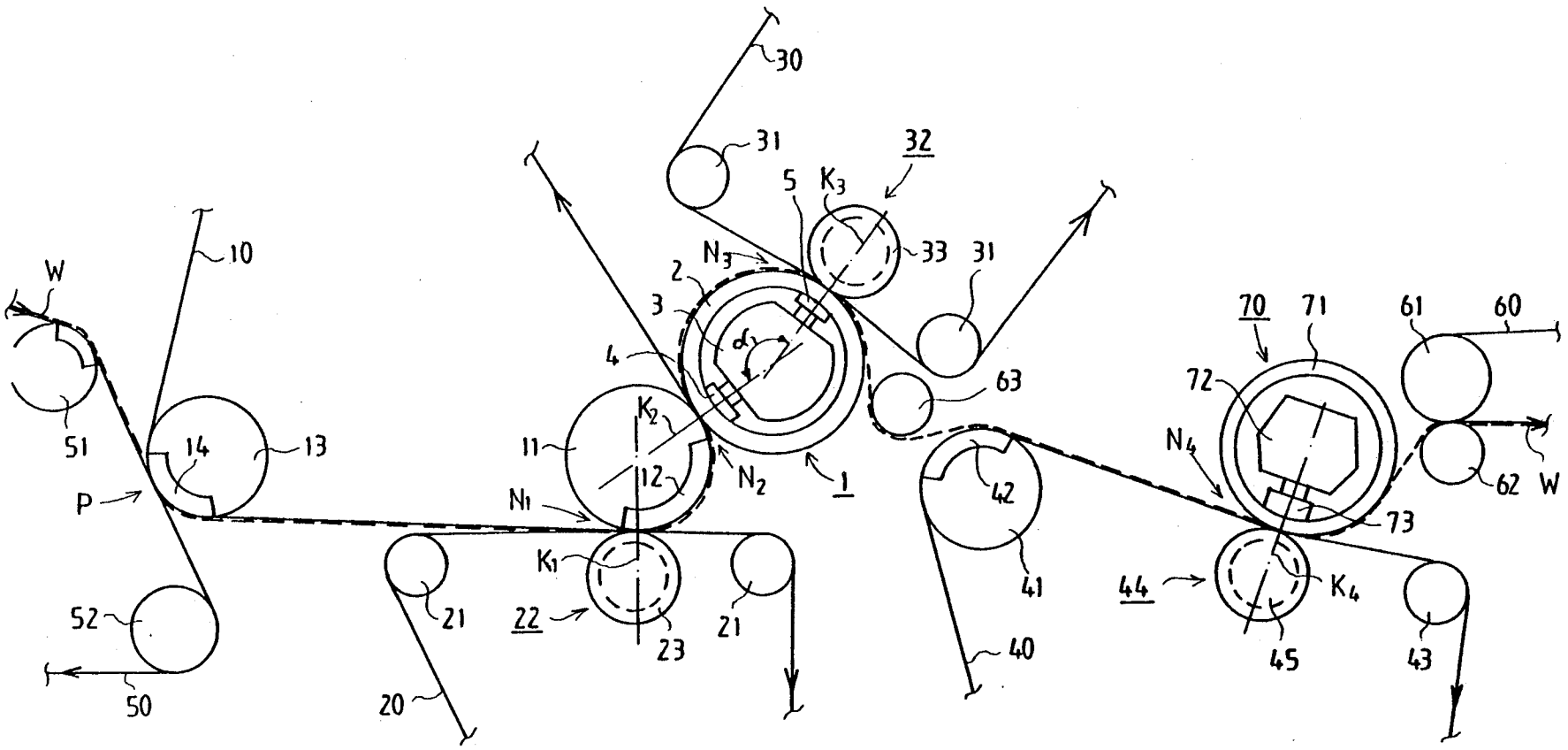
FIG. 1 is a schematical side view of the press section of a paper or paperboard making machine wherein a preferred embodiment of the invention is applied.
Figure 2:
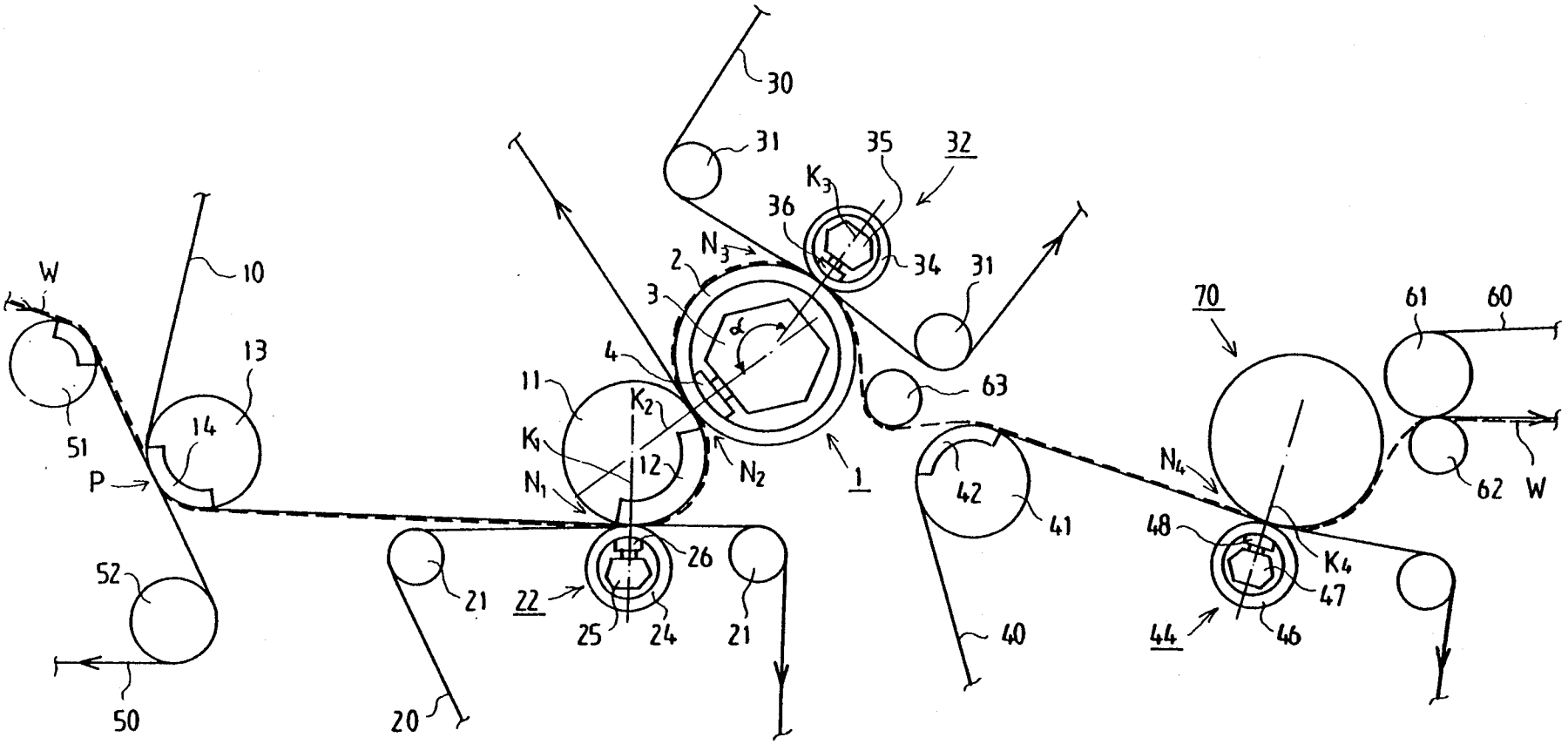
FIG. 2 is a corresponding view of an alternative preferred embodiment to the structure shown in FIG. 1.
Figure 3:
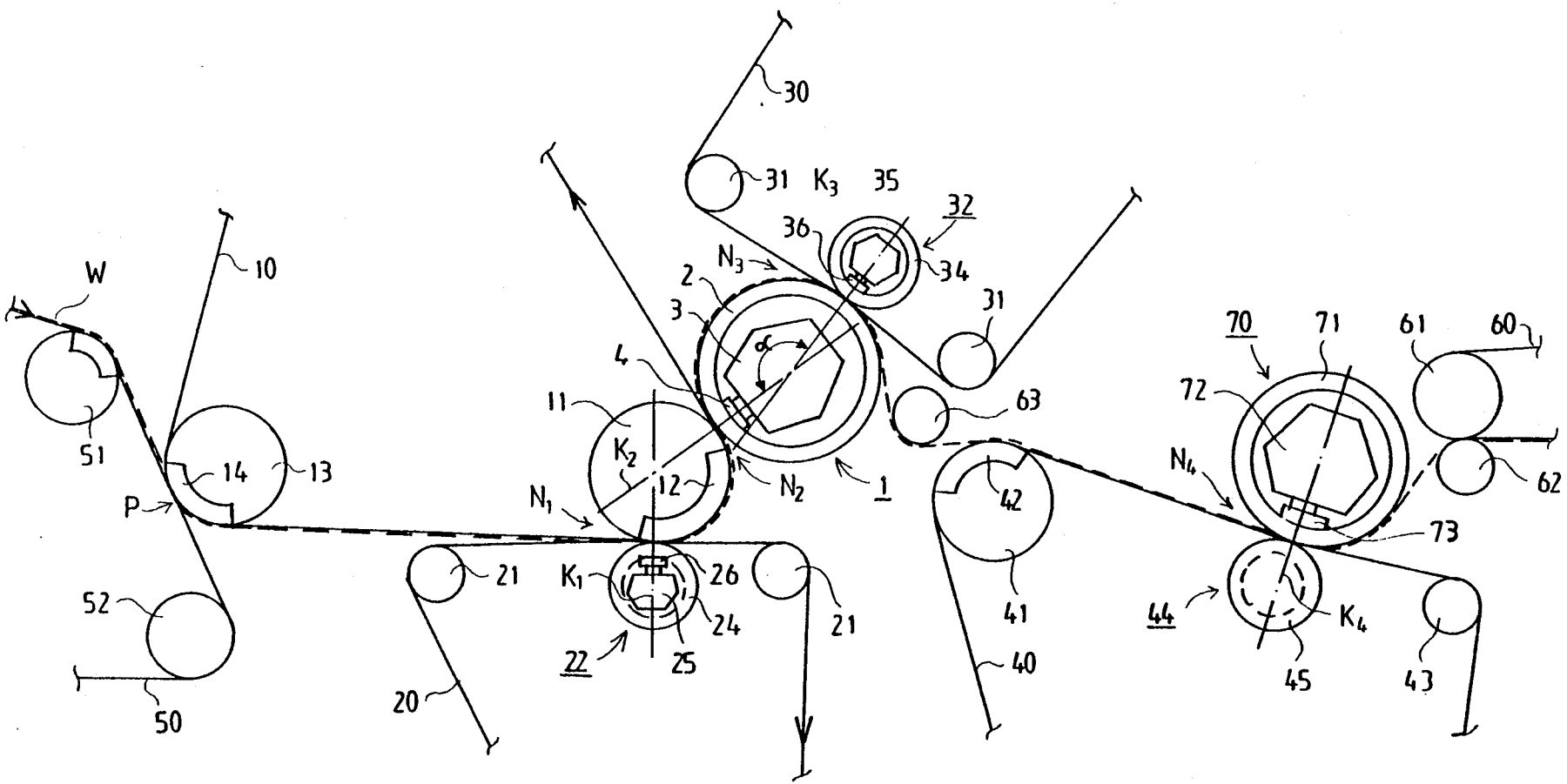
FIG. 3 is a corresponding view of a further preferred alternative embodiment of the structures shown in FIGS. 1 and 2.

As is shown in FIGS. 1, 2 and 3, the web W is formed on the wire 50, which is either a fourdrinier wire or the carrying wire of a twin-wire former. On the downwardly inclined run of the wire 50 between the wire suction roll 51 and the wire draw roll 52, the web W is transferred on the detaching line P on the suction zone 14 of the pick-up roll 13 onto the first press felt 10, which, thus, also acts as the pick-up felt. The first press felt 10 carries the web W on its lower face into the first press nip $N_1$, which is formed between two press roll, i.e. a press-section roll 11 and a grooved roll 22 or an equivalent roll provided with a hollow face 23. The first press felt 10 forms an endless loop by means of guide and alignment rolls (not shown), which also keep the first press felt 10 appropriately tensioned. The first nip $N_1$ is provided with two press felts, i.e. the first press felt 10 and a second press felt 20, the latter felt also forming an endless loop by means of guide and alignment rolls 21, which keep the second press felt 20 appropriately tensioned. The nip plane of the first nip $N_1$ is denoted with the reference $K_1$ notation.

After the first nip $N_1$ the web W is sucked by means of the suction zone 12 of the press-section roll 11 out of contact with the second press felt 20 onto the face of the first press felt 10 and, being guided by the press-suction roll 11, into the second nip $N_2$. For this purpose, the press-suction roll is provided with a suction zone 12 of appropriate length, which ensures the detaching of the web W from the second press felt 20 onto the face of the first press felt 10. The second nip $N_2$ is formed between the press-suction roll 11 and the center roll 1 in the press section. After the second nip $N_2$, the first press felt 10 is moved away from the center roll 1. Owing to the surface properties of the smooth-faced center roll 1, the web W is detached after the second nip $N_2$ from the first press felt 10 and adheres to the face of said center roll, under whose guidance the web W is thereupon transferred into the third nip $N_3$ in the press section. The third nip $N_3$ is formed between the center roll 1 and an opposite grooved roll 32 or an equivalent roll provided with a hollow face 33. Over this grooved roll 32, a third press felt 30 is passed, which is formed as an endless loop by means of guide and alignment rolls 31.

In the embodiments shown in FIGS. 1, 2 and 3, the press section further includes a fourth, separate press nip, in which case the fourth nip $N_4$ in the press section is formed between a second center roll 70, corresponding to the center roll, and an adjacent grooved roll 44 or an equivalent roll provided with a hollow face 45. After the third nip $N_3$ the web W is detached from the third press felt 30 onto the face of the center roll 1, from which it is detached by means of a transfer-suction roll 63. Thus, an open draw is formed between the center roll 1 and the transfer-suction roll 63. From the transfer-suction roll 63 the web W is transferred onto the fourth press felt 40 on the suction zone 42 of the suction roll 41, which acts as a pick-up roll. Between the transfer-suction roll 63 and the suction roll 41, there is also an open draw. The fourth press felt 40 is also a pick-up felt. The fourth press felt 40 is formed as an endless loop by means of guide and alignment rolls 43. The fourth press felt 40 transfers the web W into the fourth press nip $N_4$, after which, owing to the surface properties of the second center roll 70, the web W is detached from the fourth press felt 40 onto the face of the second center roll 70. The nip plane of the fourth nip $N_4$ is denoted with the reference notation $K_4$. From the second center roll 70, the web W is transferred onto the drying wire 60 by means of transfer-suction rolls 61 and 62, while the drying wire 60 transfers the web W further into the drying section (not shown).

FIG. 1 shows a first preferred embodiment of a press section in accordance with the invention. As is shown in FIG. 1, the center roll I in the press section is a variable-crown roll, which comprises a metallic roll mantle 2 which is arranged to revolve around a stationary roll axle 3. In the embodiment shown in FIG. 1, inside the center roll 1, crown-variation means 4 and 5 are fitted which act in the nip plane $K_2$ of the second nip $N_2$ as well as in the nip plane $K_3$ of the third nip $N_3$, by means of which crown-variation means the roll mantle 2 is loaded in the nip planes $K_2$ and $K_3$ to produce the desired linear load profile. In the embodiment of FIG. 1, the crown-variation means comprise loading shoes supported on the roll axle 3 and acting upon the inner face of the roll mantle 2. Thus, in the embodiment of FIG. 1, the center roll 1 is a roll adjustable in zones thereof, wherein the crown variation is provided in two directions, which form an angle with each other. Thus, in the embodiment shown in FIG. 1, regulation of the respective linear load profiles is accomplished both in the second nip $N_2$ and in the third nip $N_3$ in the press section. Since, in the center roll in accordance with the embodiment of FIG. 1, there are two directions of crown variation, it is necessary to employ precisely the above-mentioned loading-shoe constructions for the crown variation relay. If a crown variation were provided in the center roll 1 in one direction only for example, either in the nip plane $K_2$ of the second nip $N_2$ or in the nip plane $K_3$ of the third nip $N_3$, in such a structure it would be possible to employ any crown-variation means used in the prior art.

In the embodiment of FIG. 1, if necessary or desirable, it would also be possible to provide crown-variation means in the grooved roll 22, in which case the linear loads profile could also be controlled in the first part $N_1$ of the press section.

As has been heretofore mentioned, the press section shown in FIG. 1 also includes a fourth press nip $N_4$. Thus, in the embodiment of FIG. 1, the second center roll 70 is arranged as a variable-crown roll, so that the second center roll 70 comprises a hollow, metallic roll mantle 71, which is arranged to be revolving around a stationary roll axle 72. In the interior of the roll mantle 71, crown-variation mans 73 are provided, by which means the fourth nip $N_4$ is loaded in the direction of the nip plane $K_4$ to produce the desired linear load profile. In FIG. 1 it is shown that in the second center roll 70, as the crown-variation means 73, a loading-shoe construction similar to that described above in relation to the center roll 1 is used. However, since in the fourth, separate press it is necessary to control one regulation direction only, as the crown-variation means 73 it is possible to use any structure that has been used for this purpose in the prior-art. Thus, if necessary, or desirable, in the embodiment shown in FIG. 1, it is possible to control linear load profiles in all the press nips in the press section.

The second embodiment of the invention shown in FIG. 2 differs from that shown in FIG. 1 in the respect that, in the center roll 1, crown-variation means 4 are provided in the nip plane $K_2$ of the second nip $N_2$ only. Owing to this, in the embodiment shown in FIG. 2, as crown-variation means 4 it is possible to use any structure that has been used. In FIG. 2, the linear load profile is also regulated in the first nip $N_1$ in the direction of the nip plane $K_1$ so that the grooved roll 22 is formed as a variable-crown roll. Thus, the grooved roll 22 comprises a tubular roll mantle 24, which is mounted to revolve around the stationary roll axle 25. Inside the roll mantle 24, the necessary crown-variation means 26 are provided to regulate the linear load profile in the nip $N_1$. Since herein one direction of regulation only is concerned, as a crown-variation means it is possible to use any structure that has been used for this purpose in the prior art.

With a view to regulating the linear load profile in the third nip $N_3$ in the press section, in the embodiment shown in FIG. 2, the grooved roll 32 in said third nip $N_3$ is formed as a variable-crown roll, whose construction corresponds to that of the grooved roll 22 in the first nip $N_1$ described above. Thus, the grooved roll 32 comprises a tubular roll mantle 34, which is arranged to revolve around the roll axle 35. Further, inside the roll mantle 34, crown-variation means 36 is provided, which acts in the nip plane $K_3$ of the third nip N to regulate the profile of linear loads. Since, in this case as well, regulation is required in one direction only, the crown-variation means 36 can be embodied in several known structures. As the crown-variation means 36, it is possible to employ, for example, the loading shoes shown in FIG. 2, but in their place it is also possible to use, for example, a pressure fluid clambers or a series of such chambers provided between the roll axle 35 and the roll mantle 34. In the fourth, separate nip $N_4$ in the press section, in the embodiment shown in FIG. 2, the regulation of the load profile is arranged in a manner differing from that of FIG. 1. In the embodiment shown in FIG. 2, the grooved roll 44 in the fourth nip $N_4$ is arranged as a variable-crown roll so that the roll 44 comprises a tubular roll mantle 46, which is arranged to revolve around the axle 47 of the roll. Inside the roll mantle 46, crown-variation means 48 similar to the crown-variation means 26 and 36 of the grooved rolls 22 and 32 in the first nip $N_1$ and in the third nip $N_3$ are provided. Thus, in this embodiment, for the fourth nip $N_4$, it is possible to employ a conventional metal roll or even a rock roll as the center roll 70.

The third embodiment of the invention, shown in FIG. 3, combines some of the structural elements of the embodiments shown in FIGS. 1 and 2. In the structure shown in FIG. 3, control of the linear load profiles in the first, second and third nips $N_1$, $N_2$, $N_3$ in the press section is achieved in the same respective manners as in the structure shown in FIG. 2, and in the fourth nip $N_4$ in the same manner as is shown in FIG. 1.

Figure 4:
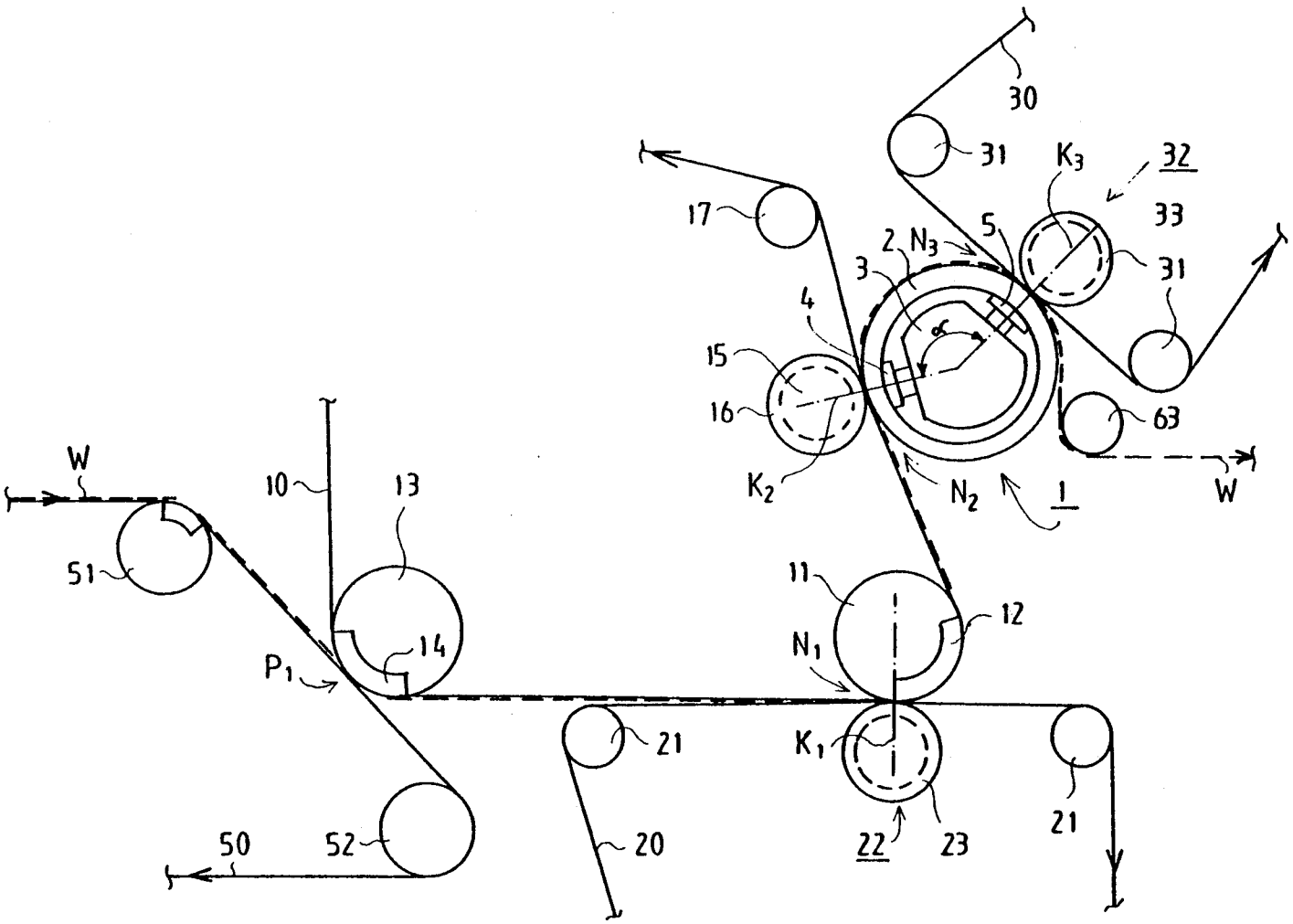
FIG. 4 shows yet another preferred alternative embodiment of a structure in accordance with the invention.

The embodiment shown in FIG. 4 differs from the embodiments of FIGS. 1–3 as follows. With respect to the first nip $N_1$ in the press section, the structure is similar to that described in the above mentioned embodiments. However, in FIG. 4, the second nip $N_2$ in the press section is not formed between the press-suction roll 11 and the center roll 1, but in this embodiment, on the run of the first press felt 10 after the press-suction roll 11, a grooved roll 15 or an equivalent roll provided with a hollow face 16 is provided, which forms the second nip $N_2$ in the press section with the center roll 1. The first press felt 10 is formed as an endless loop, as is the case in the other embodiments, by means of guide and alignment rolls 17. In the embodiment of FIG. 4, the construction and the operation of the center roll 1 are identical with those of the center roll shown in FIG. 1. The grooved roll 32 in the third nip $N_3$ and the related constructions are also, in this embodiment, identical with those shown in FIG. 1. In the solution of FIG. 4, a fourth, separate press nip is not shown but in this structure the web W can be transferred by means of the transfer-suction roll 63 directly onto the drying wire (not shown). It is clear, however, that this embodiment can also be provided with a fourth, separate press nip similar to that described in relation to the embodiments described above. In a corresponding way, it is fully clear that the embodiments of FIGS. 1, 2 and 3 may also be accomplished without a fourth, separate press.

Details of the present invention may easily vary within the scope of the inventive concepts set forth above, which have been presented by way of example only. Therefore, the preceding description of the present invention is merely exemplary, and is not intended to limit the scope thereof in any way.

What is claimed is:

1. A press section of a paper or paperboard making machine comprising:

a plurality of rolls, adjacent ones of said plurality of rolls forming therebetween respective press nips, a web arranged to run through said press nips to be thereby dewatered, at least one of said plurality of rolls being a first smooth-faced center roll which forms a first and second press nip with first and second adjacent rolls of said plurality of rolls, respectively, press felts which pass over said adjacent rolls and through said first and second press nips, said press felts adapted to absorb water from said web, said first smooth-faced center roll comprising a stationary roll axle and a metallic roll mantle arranged to revolve around said stationary roll axle, a first crown-variation means arranged in said first center roll in conjunction with said first press nip, a second crown-variation means in said first center roll arranged asymmetrically from said first crown-variation means in conjunction with said second press nip, said first and said second crown-variation means functioning together to load said roll mantle in the directions of a nip plane of said first press nip and a nip plane of said second press nip, respectively, so as to control the respective linear load profiles of said first and second press nips.

2. The press section of claim 1, wherein said first crown-variation means comprises a pressure fluid chamber situated between said metallic roll mantle and said stationary roll axle.

3. The press section of claim 1, wherein said first crown-variation means comprises a series of pressure fluid chambers situated between said metallic roll mantle and said stationary roll axle.

4. The press section of claim 1, wherein said first and said second nip planes form an angle with each other greater than zero degrees and less than 180 degrees.

5. The press section of claim 1, wherein said first crown-variation means and said second crown-variation means each comprise a respective loading shoe which is supported by said stationary roll axle.

6. The press section of claim 4, wherein said first crown-variation means and said second crown-variation means each comprise a respective loading shoe which is supported by said stationary roll axle.

7. The press section of claim 1, wherein a third roll of said plurality of rolls defines an additional press nip with said first adjacent roll, said third roll comprising a grooved roll and said first adjacent roll comprising a press-section roll.

8. The press section of claim 7, further comprising a second smooth-faced center roll located after said first center roll in the direction of the running of the web, said second smooth-faced center roll comprising a stationary roll axle and a metallic roll mantle arranged to revolve around said stationary roll axle, and a fourth roll of said plurality of rolls, said fourth roll defining a fourth press nip with said second smooth-faced center roll, said second smooth-faced center roll having crown-variation means functioning to control the linear load profile of said roll mantle in a direction of a nip plane of said fourth press nip.

9. A press section of a paper or paperboard making machine comprising:

a plurality of rolls, adjacent ones of said plurality of rolls forming therebetween respective press nips, a web arranged to run through said press nips to be thereby dewatered, at least one of said plurality of rolls being a first smooth-faced center roll which forms a first and second press nip with first and second adjacent rolls of said plurality of rolls, respectively, press felts which pass over said adjacent rolls and through said first and second pres nips, said press felts adapted to absorb water from said web, said first smooth-faced center roll comprising a stationary roll axle and a metallic roll mantle arranged to revolve around said stationary roll axle, a first crown-variation means arranged in said first center roll in conjunction with said first press nip, a second crown-variation means being arranged asymmetrically from said first crown-variation means in conjunction with said second press nip, said first and said second crown-variation means functioning together to load said roll mantle in the directions of a nip plane of said first press nip and a nip plane of said second press nip, respectively, so as to control the respective linear load profiles of said first and second press nips.

10. The press section of claim 9, further comprising a third roll of said plurality of rolls forming a third press nip with said first adjacent roll, said third roll comprising third crown-variation means to load said third roll in the direction of a nip plane of said third press nip.

11. The press section of claim 10, further comprising a second smooth-faced center roll located after said first center roll in the direction of the running of the web, said second smooth-faced center roll comprising a stationary roll axle and a metallic roll mantle arranged to revolve around said stationary roll axle, and a fourth roll of said plurality of rolls, said fourth roll defining a fourth press nip with said second smooth-faced center roll, said second smooth-faced center roll comprising crown-variation means to load said second smooth-faced center roll in the direction of a nip plane of said fourth press nip.

12. The press section of claim 10, further comprising a second smooth-faced center roll located after said first center roll in the direction of the running of the web, said second smooth-faced center roll comprising a stationary roll axle and a metallic roll mantle arranged to revolve around said stationary roll axle, and a fourth roll of said plurality of rolls, said fourth roll defining a fourth press nip with said second smooth-faced center roll, said fourth roll of said plurality of rolls comprising crown-variation means to load said fourth roll in the direction of a nip plane of said fourth press nip.

* * * * *